United States Patent [19]

Virvo

[11] Patent Number: 5,046,273

[45] Date of Patent: Sep. 10, 1991

[54] PORTABLE DISPLAY SYSTEM

[76] Inventor: Alexander Virvo, 33 Glenn Ter., Stamford, Conn. 06902

[21] Appl. No.: 364,801

[22] Filed: Jun. 12, 1989

[51] Int. Cl.[5] ..... G09F 13/04

[52] U.S. Cl. ..... 40/571; 40/575; 40/611

[58] Field of Search ..... 40/571, 575, 577, 610, 40/124.2, 124.4, 611; 206/45.26, 45.29, 449, 39, 232

[56] References Cited

U.S. PATENT DOCUMENTS

| | | | |
|---|---|---|---|
| 1,462,351 | 7/1923 | Michelsen | 40/577 |
| 1,625,708 | 4/1927 | Carraine | 40/571 |
| 1,697,641 | 1/1929 | Giett et al. | 40/611 |
| 1,988,765 | 1/1935 | Wolf | 40/571 |
| 2,088,773 | 8/1937 | Tabor | 40/571 |
| 2,264,965 | 12/1941 | Broderick | 40/571 |
| 3,381,401 | 5/1968 | Fuller, Jr. | 40/575 |
| 3,977,521 | 8/1976 | Murphy | 40/611 |
| 4,085,762 | 4/1978 | O'Brien | 40/610 |
| 4,130,197 | 12/1978 | Fox | 206/45.26 |
| 4,242,821 | 1/1981 | McNeil | 40/572 |
| 4,602,712 | 7/1986 | Williams | 206/39 |
| 4,651,872 | 3/1987 | Joyce | 40/124.2 |

FOREIGN PATENT DOCUMENTS

| | | | |
|---|---|---|---|
| 2410322 | 7/1979 | France | 40/606 |
| 2031799 | 4/1980 | United Kingdom | 40/124.2 |

*Primary Examiner*—Kenneth J. Dorner
*Assistant Examiner*—Brian K. Green
*Attorney, Agent, or Firm*—Grimes & Battersby

[57] ABSTRACT

A collapsible, illuminated, graphic display device designed to display graphic advertising messages which may be interchanged. In addition to holding the messages, the front panel contains pockets to hold materials such as brochures and business cards for distribution. It further contains a slotted arrangement to receive messages or business cards. The device may be employed for a tabletop display and has triangular sides to hold the viewing panel at an optimum angle for observation.

3 Claims, 7 Drawing Sheets

PORTABLE DISPLAY SYSTEM

BACKGROUND OF THE INVENTION

1. Field of the Invention

The present invention relates generally to graphic display devices that may be positioned on table tops for advertising, making presentations or other purposes where it is desirable to present graphic messages to an audience. The invention not only presents graphic message displays but it is also designed to facilitate the distribution and receipt of written informational material as brochures and business cards.

2. Description of the Prior Art

Illuminated signs and exhibiting devices or light boxes are well known and are customarily used in retail stores for counter displays and advertising.

Some of these prior art viewers are collapsible for easy transportation and have printed material as in the form of pads available for distributing information about the product being advertised.

Illustrative of the prior art are the following patents:

| | |
|---|---|
| 1,591,957 | 4,130,197 |
| 1,638,761 | 4,152,852 |
| 2,086,893 | 4,242,821 |
| 2,602,252 | 4,497,127 |
| 2,962,825 | |

As representative of the prior art U.S. Pat. No. 2,086,893 to Belden shows a collapsible sign used to display an appropriate advertising message. The unit contains an internal light bulb to illuminate the message and the sign may be collapsed for convenient transportation. However, the unit fails to show an arrangement for readily and conveniently changing the display signs and is more adapted for a fixed permanent advertising display. In addition, it makes no provision for distribution or receipt of message material.

U.S. Pat. No. 1,638,761 to Dieudonne is directed to a name plate type of sign of triangular cross section containing a light bulb to illuminate the name. It does provide for changing the displayed name but it is a simple non-collapsible desk type name display device and is not suitable for presenting a variety of graphic information.

U.S. Pat. No. 4,130,197 to Fox shows a display device that includes a pocket for holding coupons or other printed information relating to the display. It, however, is not an illuminated, collapsible mechanism for ready presentation and convenient portability. The remaining above cited patents are similarly representative of the prior art.

These prior art devices lack a design that provides optimum presentation of an easily changeable graphic message along with a design for the distribution of written material such as brochures as well as an arrangement to receive written material as messages and business cards. These prior art devices are generally directed to message advertising and viewing boxes as distinguished from a multi-functional unit designed to enhance business presentations.

SUMMARY OF THE INVENTION

Against the foregoing background, it is a primary object of the present invention to provide a modular display system for presenting readily changeable graphic messages as well as the distribution and receipt of written material.

It is a further object of the present invention to provide a modular display system in which the elements are all hinged together to form a unitary structure that can be folded flat for convenient transportation.

It is still another object of the present invention to provide a graphic modular display system for convenient table top use in which the graphic messages may be readily and conveniently changed and in which the system has elements for distributing and receiving message material.

BRIEF DESCRIPTION OF THE DRAWINGS

The foregoing and still other objects and advantages of the present invention will be more apparent from the following detailed explanation of the preferred embodiments of the invention in connection with the accompanying drawings wherein.

DESCRIPTION OF THE PREFERRED EMBODIMENT

Figure 1:
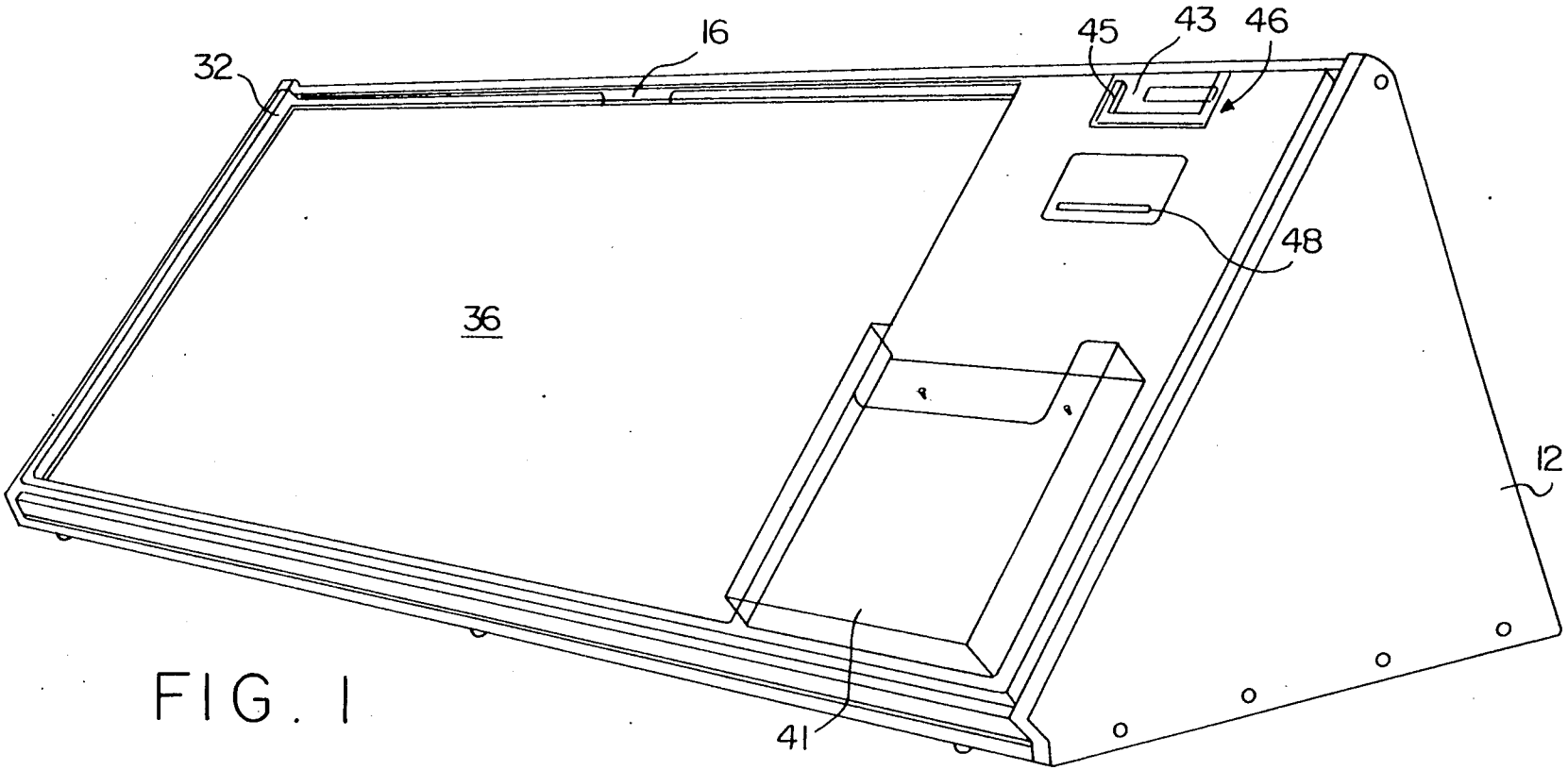
FIG. 1 is a perspective of the display system showing the front panel and right side.
Figure 2:
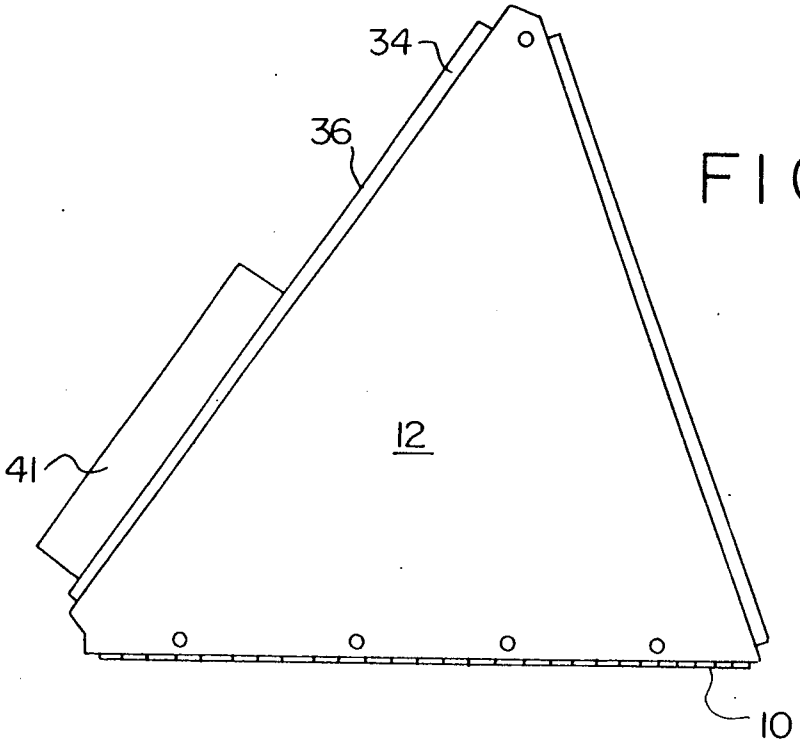
FIG. 2 is an elevation of the right side.
Figure 3:
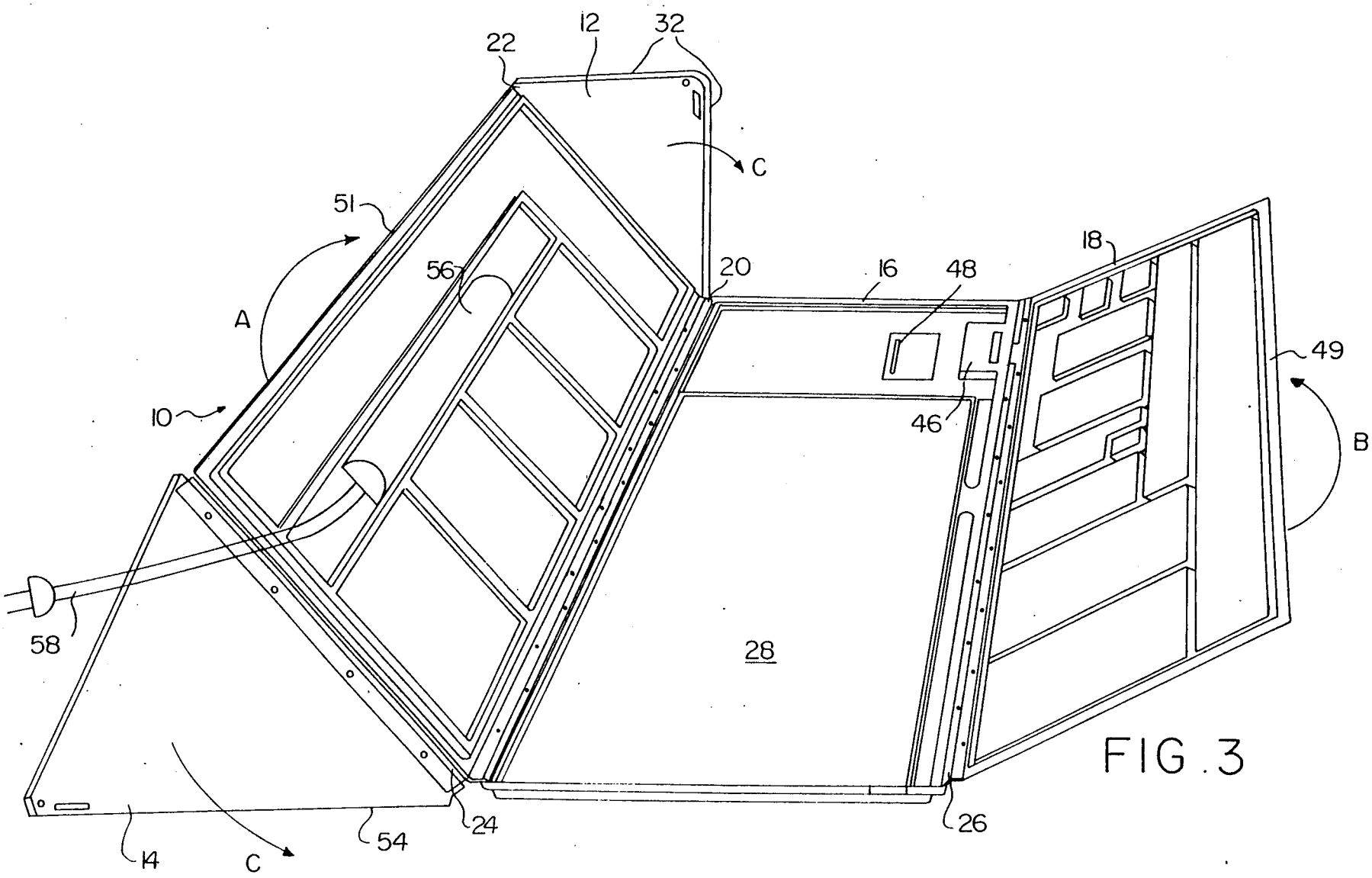
FIG. 3 is a perspective of the system in a flat, open condition.

Referring to the drawings and more particularly to FIGS. 1, 2, and 3, the display module of the present invention includes a bottom panel 10, side or end triangular members 12 and 14, a front panel 16 and a rear panel 18. Each panel may be formed, as by molding, of a suitable plastic material, preferably polystyrene, or acrylonitrile butadiene styrene, or other material, such as wood, or aluminum. Each panel, preferably, is of unitary construction.

Front panel 16 is secured to the bottom panel 10 by hinge 20 as more readily seen in FIG. 3. The hinge may be an elongated one extending essentially the full width of the two panels. The side panels 12, 14 are similarly hinged to the ends of bottom panel 10 as by hinges 22, 24 and the back panel 18 is secured to the upper edge of front panel 16 by hinge 26.

Figure 5:
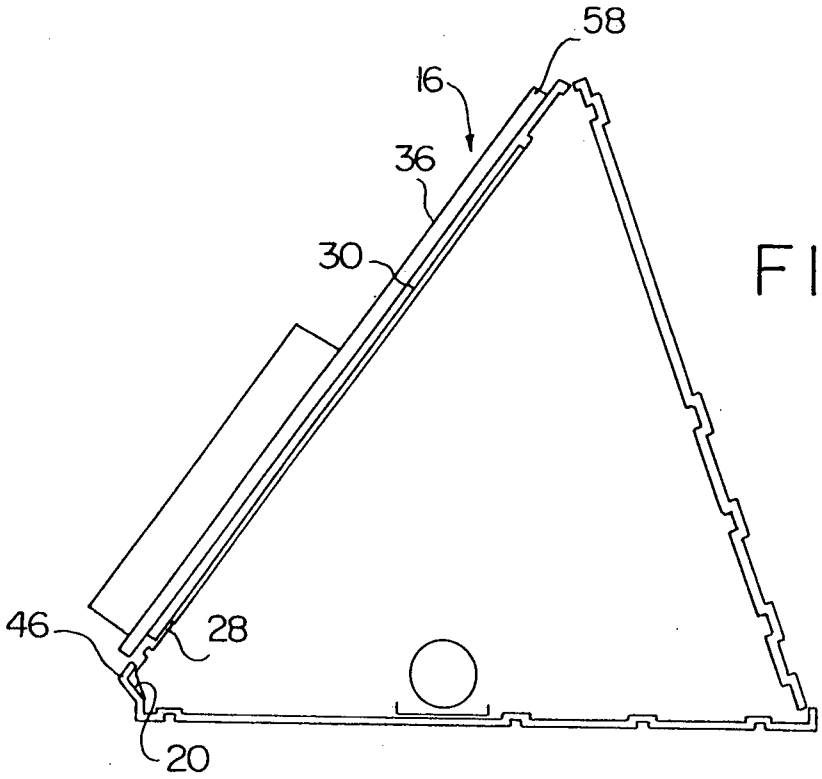
FIG. 5 is a cut away side view.

It is seen that the three panels and sides are all secured together by hinges to provide a collapsible unitary structure that may be unfolded, as shown in FIG. 3, to a flat configuration and folded to the upright display position of FIGS. 1, 2 and 5. In addition, and of particular importance, is that the ends, front and back panels may all be folded over so that they form a flat compact assembly for transporting the device to various locations as a piece of hard luggage.

Front panel 16 has a rectangular window 28 or cut out portion to provide an opening to the interior of the device when in the folded viewing position. The window 28 is covered by a translucent panel 30 that is slightly larger than the cutout window 28. The panel 30 is secured in place as by cementing to the edge or border of the cutout 28.

Figure 4:
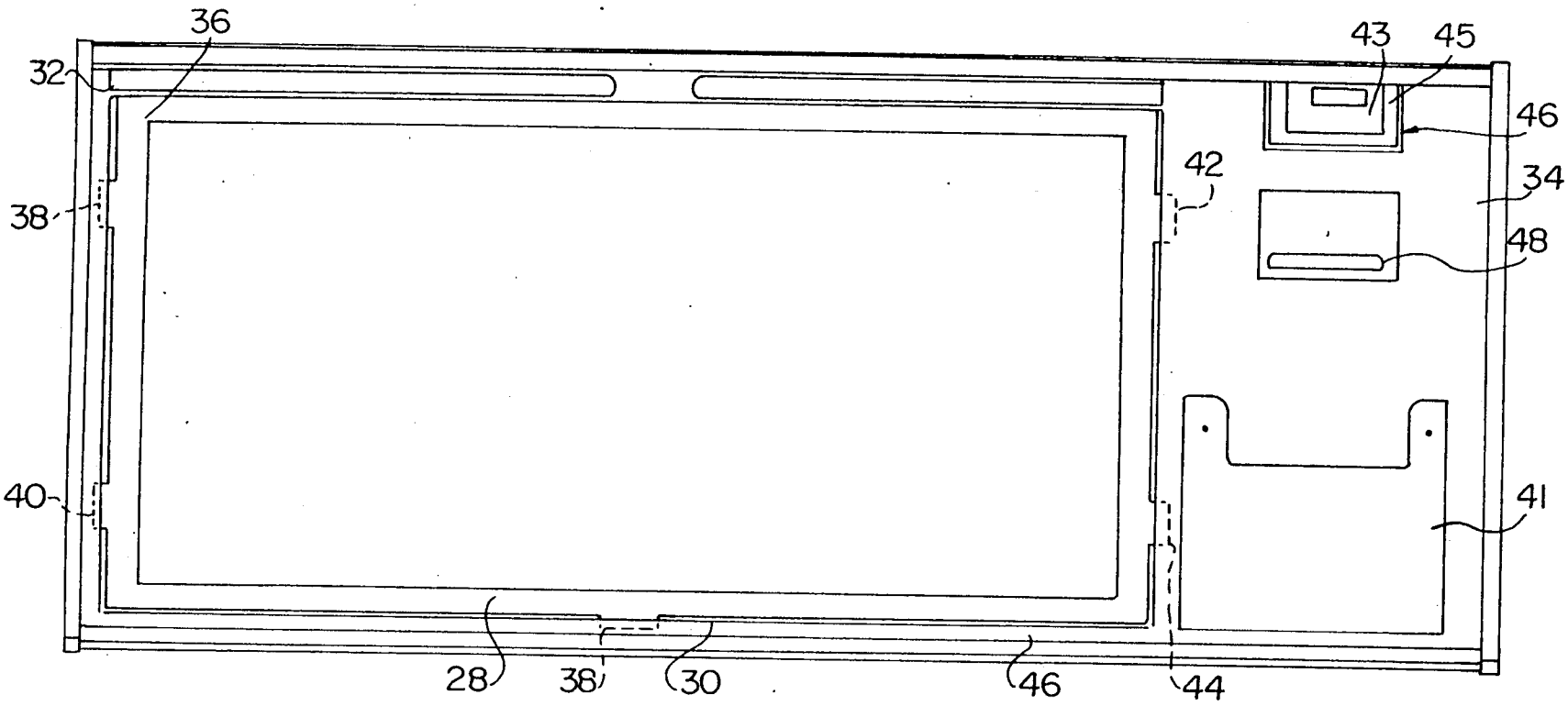
FIG. 4 is a front view of the front panel with the transparent window in place.

As seen more clearly in FIGS. 4 and 5, the front panel is molded to have a raised rib 32 along the left side and a raised rectangular portion 34 on the right side. These raised portions of front panel 16 extend outwardly beyond the upper surface of the translucent panel 30. A transparent front window 36 that may be made of clear plexiglass is positioned over the translucent panel 30. This window is held in place with a slight space between it and the translucent panel 30 by means of four tabs 38, 40, 42, 44 on opposite edges of the window. The four tabs 38, 40, 42, 44 are received in slots provided in raised rib 32 and element 34 as seen in FIG. 4.

The lower edge of plexiglass window 36 may abut the raised lower rib 46 on the front panel. It is seen that the slightly spaced apart translucent panel 30 and clear window 36, at their upper edges, provide an unobstructed slot for graphic messages to be inserted.

The message panel 59 is seen inserted in place for viewing in FIG. 5. It is understood that various message panels having different graphic messages may be separately inserted in place for viewing between panel 30 and clear window 36.

A pocket or brochure holder 41 is secured to front panel 16 alongside of the window and may be made of any suitable material such as polystyrene. The pocket may be secured to the panel by any convenient means such as velcro, hooks, pegs, cementing, etc., and may be removable so that pockets of different size may be affixed in accordance with the brochures or other material to be distributed.

Molded into the front panel 16 is a rectangular depression 43 having a U-shaped frame 45 forming a business card holder 46 that extends inwardly of the panel as seen in FIG. 3 and is open in the front as shown in FIG. 1 to conveniently hold standard size business cards which viewers of the display system may take. A slot 48 is cut in front panel 16 just below business card holder 46 to receive business cards or messages of those viewing the display system. Accordingly, business cards received in the slot 48 are retained in the display unit and, therefore, cannot be removed until the unit is disassembled or unfolded. Thus, the owner of the display is assured of retaining the business cards.

In its unfolded or open position, the display system may lay flat (not shown). As shown in FIG. 3, to assemble the system for display, the bottom panel 10 is pivoted, as shown by arrow A, upwardly at hinge 20 and the back panel 18, pivoting at hinge 26, as shown by arrow B, is brought to a position where the panel edge 49 rests against back edge 51 of the bottom panel. The sides 12 and 14 are then pivoted, as shown by arrows C, upwardly to the position shown in FIG. 1. Side 12 has bent forward edges 52 and side 14 bent forward edges 54 so that when the sides are in their upward position the edges 52 and 54 overlap the left and right ends of front panel 16 and back panel 18 to cover the ends thereof and present an attractive appearance. The side panels, preferably, have an industrial fastener which comprises a male and female velcro fastener portion to hold the sides in place. Specifically, either the male or female fastener portion is attached by conventional means to one panel, such as side 12, while the other fastener portion is attached, by conventional means to the other panel, such as front panel 16.

A suitable light source 56, such as, for example, a light fixture, which maybe of the fluorescent type is adapted to rest in the bottom panel and its connecting wire 58 may be led through a notch 68 in a corner of the bottom panel. Thus, a graphic message is moved or slides in place between the translucent panel 30 and transparent window 36 so as to be illuminated for viewing.

Figure 6:
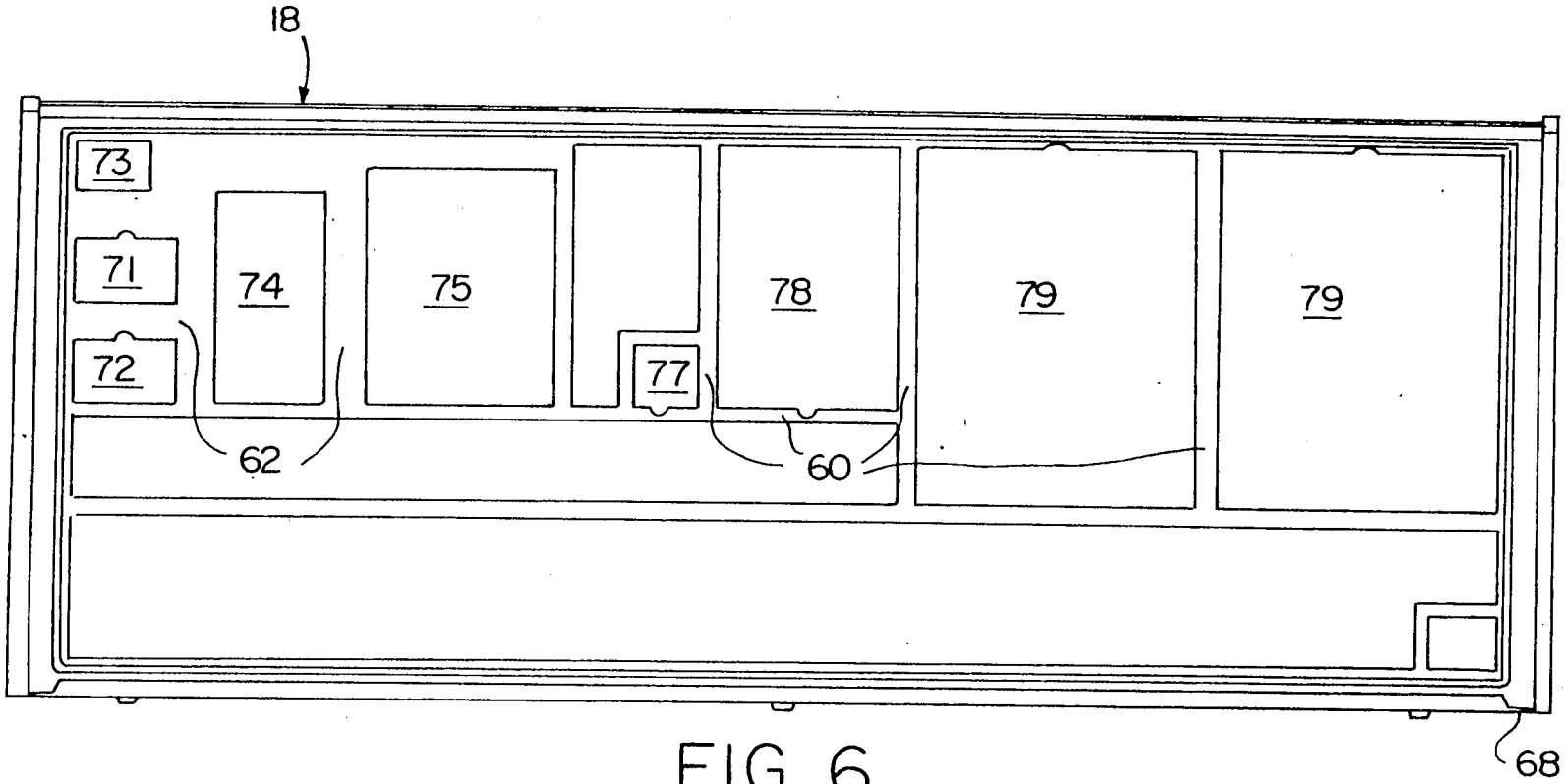
FIG. 6 is a partial elevation of the back panel.

FIG. 6 shows the outer surface of the rear or back panel 18 and it is seen that it is molded to form a plurality of shallow compartments 71 through 79 divided by upstanding ribs 60, 62. The compartments can be of any size and configured to accommodate various articles therein. For example, compartments 71 and 72 can be holders for additional business cards. Compartment 73 maybe a receptacle for receiving a clock. It is preferable that compartments 74 and 75 be sized to receive a calendar and calculator, respectively. Compartment 76 may, in fact, be an area for holding a pen with a cord which is adapted to fasten to the rear panel 18 so that the pen will not be lost. It is also preferable to have a compartment for holding one or more sized pads. Accordingly, compartment 77 is sized and configured to hold a conventional by sized notes, such as the Post-It notes sold by 3M, while compartment 78 is sized and configured to hold a conventionally sized pad. Lastly, compartments 79 is provided to hold brochures and, alternatively, one or both of these compartments can be adapted to hold a large sized pad. Thus, the compartments provide holders for various articles which can be added to the overall display unit.

Figure 7:
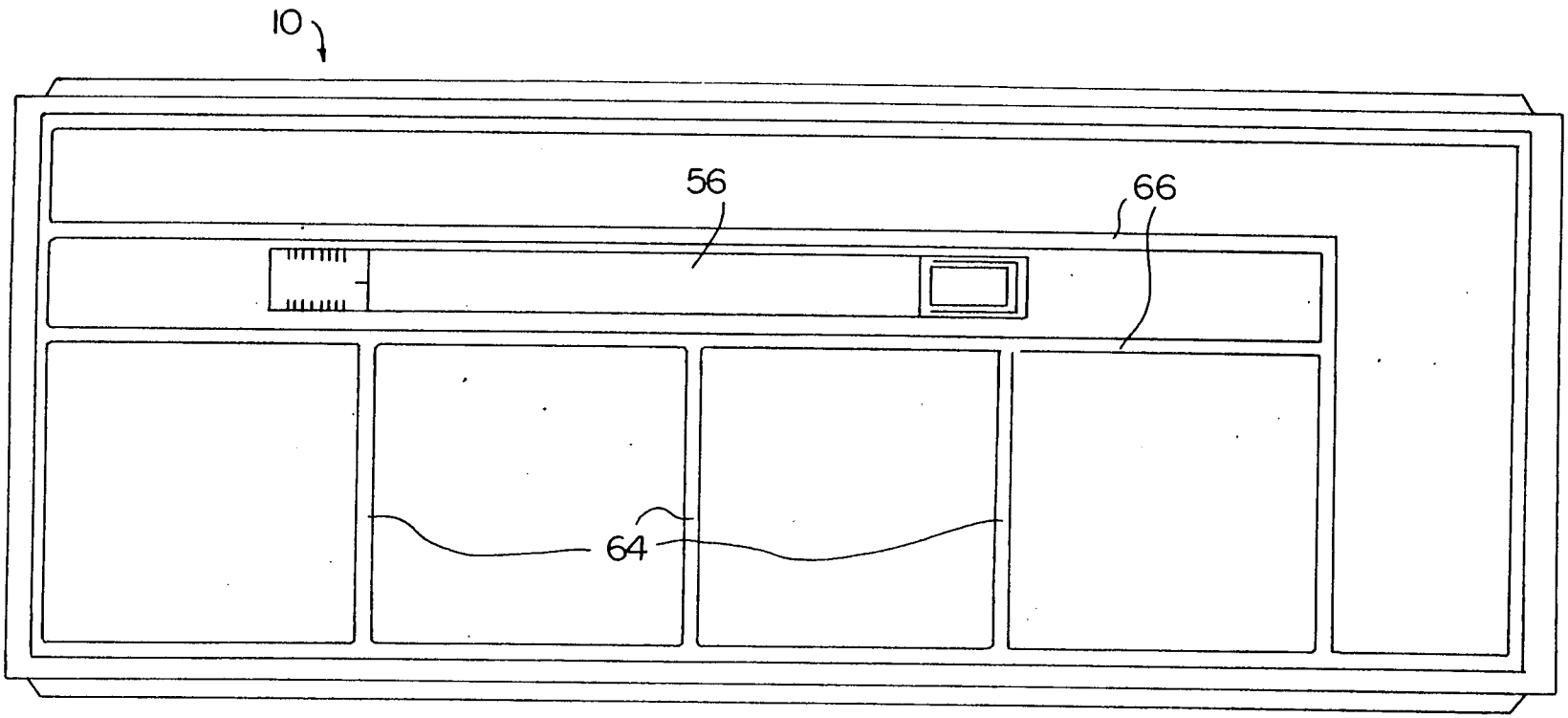
FIG. 7 is a top view of the bottom panel.

As seen in FIG. 7, the upper surface of bottom member is also molded to form a plurality of shallow compartments separated by ribs 64, 66. These compartments may take various shapes and forms and serve to hold during transporting and assembly materials and items used in the presentation to which the display unit is employed.

To summarize, the present modular display system is engineered in triangular form to provide a viewing surface, with an optimum angle of about 38 degrees. The display system is three dimensional, lightweight, fully collapsible and portable. It has removable brochure holders that can be custom sized to the individual material. Further, it contains a business card holder and a dropslot to receive business cards or messages.

The graphic panels provide visual messages that may be changed and easily slip in and out of a clear plexiglass front panel. A fluorescent light source may be located on the bottom panel to eliminate the message.

The device has special utility, not only for advertising displays but for presentations at trade shows, seminars, and wherever informational meetings are held.

Having thus described the invention with particular reference to the preferred forms thereof, it will be obvious that various changes and modifications may be made therein without departing from the spirit and scope of the invention as defined by the appended claims.

Wherefore, we claim:

1. A modular display device for presenting information comprising:

a bottom panel;

a front panel hinged to said bottom panel;

a back panel hinged to said front panel;

a pair of end members each hinged along one side thereof to opposite edges of one of said bottom, front and back panels, whereby said device maybe folded into a rigid enclosed triangular structure;

said front panel having a cutout section for providing a viewing area and having pocket means formed therein for receipt of materials within the pocket means;

a translucent panel secured in place over said cutout section;

a transparent panel secured in place over said translucent panel; and means holding said transparent panel over said translucent panel for forming an unobstructed slot between a top edge of said transparent panel and a top edge of said translucent panel whereby graphic messages may be received in the viewing area, wherein said front panel has a raised rib along a first side and a raised portion along a second side opposite to said first side with said raised rib and said raised portion having tab receiving slots therein, and wherein opposite edges of said transparent panel have tab means for receipt into said tab receiving slots to support said transparent panel over said translucent panel to form a slight space therebetween.

2. A modular display device for presenting information comprising:

a bottom panel having a front edge and a pair of side edges;

a front panel having a top edge and a bottom edge, said front panel hinged to the front edge of said bottom panel;

a back panel having a top edge hinged to the front panel;

a pair of end members each hinged along one side thereof to opposite one of said bottom, front and back panels, whereby said device maybe folded into a rigid enclosed triangular structure;

said front panel having a cutout section providing a viewing area;

a translucent panel secured in place over said cutout section;

a clear transparent panel secured in place over said translucent panel;

light means located on said bottom panel and in said device whereby diffused light is provided at the viewing area; and an unobstructed slotted opening between the top edge of said translucent panel and the top edge of said clear transparent panel whereby graphic messages may be inserted to be received in the viewing area, wherein said front panel has a raised rib along a first side and a raised portion along a second side opposite to said first side, said raised rib and said raised portion having tab receiving slots therein, and wherein opposite edges of said transparent panel have tab means for receipt into said tab receiving slots to support said transparent panel over said translucent panel to form a slight space therebetween.

3. A foldable modular display device for presenting information comprising:

a rectangular bottom panel having a front edge;

a rectangular front panel having a bottom edge hinged to the front edge of said bottom panel, and having a top edge;

a rectangular back panel having a top edge hinged to the top edge of the front panel;

a pair of triangular end members each hinged along one side thereof to opposite edges of said bottom panel whereby said device maybe folded into a rigid enclosed triangular structure;

said front panel having a rectangular cutout section providing a viewing area;

a translucent panel secured in place covering said cutout section;

a clear transparent panel secured in place over said translucent panel;

a fluorescent light source located on the rectangular bottom panel whereby diffused light is provided at the viewing area;

an unobstructed slotted opening between a top edge of said translucent panel and a top edge of said clear transparent panel whereby graphic messages may be inserted to be received in the viewing area;

a pocket secured to the front surface of said front panel adapted to hold sheets of written material;

card holding means in the front surface of said front panel adapted to hold a supply of business cards; and a slot cut through said front panel whereby messages and business cards may be deposited to be received into the interior of the enclosed triangular structure and cannot be removed until the structure is unfolded, wherein said front panel has a raised rib along a first side and a raised portion along a second side opposite to said first side, said raised rib and said raised portion having tab receiving slots therein, and wherein opposite edges of said transparent panel have tab means for receipt into said tab receiving slots to support said transparent panel over said translucent panel to form a slight space therebetween.

* * * * *